US011139100B2

(12) United States Patent
Takahashi

(10) Patent No.: US 11,139,100 B2
(45) Date of Patent: Oct. 5, 2021

(54) COOLING STRUCTURE FOR COIL COMPONENT

(71) Applicant: Fuji Electric Co., Ltd., Kanagawa (JP)

(72) Inventor: Kiyoshi Takahashi, Kanagawa (JP)

(73) Assignee: FUJI ELECTRIC CO., LTD., Kanagawa (JP)

( * ) Notice: Subject to any disclaimer, the term of this patent is extended or adjusted under 35 U.S.C. 154(b) by 1127 days.

(21) Appl. No.: 15/641,518

(22) Filed: Jul. 5, 2017

(65) Prior Publication Data

US 2017/0301450 A1 Oct. 19, 2017

Related U.S. Application Data

(63) Continuation of application No. PCT/JP2016/061050, filed on Apr. 5, 2016.

(30) Foreign Application Priority Data

May 15, 2015 (JP) ..... JP2015-100099

(51) Int. Cl.
*H01F 27/08* (2006.01)
*H01F 27/28* (2006.01)
*H01F 30/12* (2006.01)

(52) U.S. Cl.
CPC ..... *H01F 27/085* (2013.01); *H01F 27/28* (2013.01); *H01F 27/2876* (2013.01); *H01F 30/12* (2013.01)

(58) Field of Classification Search
CPC ..... H01F 27/025; H01F 27/08; H01F 27/085; H01F 27/14; H01F 27/20; H01F 27/2876; H01F 2027/328; H01F 6/04; H01F 30/12
(Continued)

(56) References Cited

U.S. PATENT DOCUMENTS 4,245,206 A * 1/1981 Daikoku ..... H01F 27/322 336/185
2008/0061919 A1* 3/2008 Marek ..... H01F 27/2871 336/207
2016/0027568 A1* 1/2016 Takauchi ..... H01F 27/266 336/60

FOREIGN PATENT DOCUMENTS

CN 1367502 A 9/2002
JP 2008-277482 A 11/2008
(Continued)

OTHER PUBLICATIONS

English translation of Written Opinion (PCT/ISA/237) issued in PCT/JP2016/061050 dated Jun. 2016.
(Continued)

*Primary Examiner* — Tszfung J Chan
(74) *Attorney, Agent, or Firm* — Chen Yoshimura LLP

(57) ABSTRACT

A coil device with a cooling structure includes: a coil unit that has a core structure having one or more leg parts and one or more coils wound around the one or more leg parts; and a flow-rectifying member having a flat plate portion covering a face of the one or more coils and flow-rectifying ribs inwardly protruding from an inner surface of the flat plate portion, the flow-rectifying ribs extending in a direction parallel to center axes of the one or more coils and being positioned to face side boundaries of the face of the one or more coils. The flat plate portion and the flow-rectifying ribs form a first air cooling channel at a substantially uniform gap outside of the one or more coils along the direction parallel to the center axes thereof, the first air cooling channel passing cooling air to air-cool the one or more coils.

5 Claims, 6 Drawing Sheets

(58) Field of Classification Search
USPC ..... 336/55, 57, 58, 59, 60
See application file for complete search history.

(56) References Cited

FOREIGN PATENT DOCUMENTS

| | | | | | |
|---|---|---|---|---|---|
| JP | 2011-71190 | A | | 4/2011 | |
| JP | 2011071190 | A | * | 4/2011 | |
| JP | 2013-191623 | A | | 9/2013 | |
| JP | 2013191623 | A | * | 9/2013 | |
| WO | WO-2014177534 | A1 | * | 11/2014 | ..... H01F 5/02 |
| WO | 2015/008359 | A1 | | 1/2015 | |

OTHER PUBLICATIONS

Chinese Office Action dated Feb. 27, 2018, in a counterpart Chinese patent application No. 201680004911.9.
International Search Report (ISR) issued in PCT/JP2016/061050 dated Jun. 2016.
Written Opinion (PCT/ISA/237) issued in PCT/JP2016/061050 dated Jun. 2016.

* cited by examiner

COOLING STRUCTURE FOR COIL COMPONENT

BACKGROUND OF THE INVENTION

Technical Field

The present invention relates to a cooling structure for air cooling coil units such as transformers or reactors.

Background Art

FIGS. 5A to 5C show a core-type reactor described in Patent Document 1: FIG. 5A is a plan view, FIG. 5B is a front view, and FIG. 5C is a right side view.

In these drawings, reference number 101 is the core structure, and coils 102 and 103 are wound around the pair of leg parts of the core structure. A flow-rectifying member 104 made of an insulating material is also disposed so as to surround a portion of the coils 102 and 103 in the axial direction.

FIG. 6 is a plan view for describing the cooling effects of this conventional technology. Reference numbers 101*a* and 101*b* indicate magnetic gaps formed in the core structure 101.

In FIG. 6, when a high-frequency current flows to the coils 102 and 103, not only does the temperature of the coils 102 and 103 increase, but so does the temperature of the core structure 101 having the magnetic gaps 101*a* and 101*b*.

In the structure shown in FIG. 6, the flow-rectifying member 104 is disposed such that the axial-direction end 104*a* of the flow-rectifying member 104 protrudes from an end 101*c* of the core structure 101. This forms an airflow A of cooling air along the inner surface of the end 104*a*, and a portion of this airflow A becomes airflows B1 and B2, which pass through gaps 102*a* and 103*a* between the coils 102 & 103 and the leg parts of the core structure 101.

In the conventional technology, these airflows A, B1, and B2 cool the coils 102 & 103 and the core structure 101.

RELATED ART DOCUMENT

Patent Document

Patent Document 1: Japanese Patent Application Laid-Open Publication No. 2013-191623 (FIGS. 2-4)

SUMMARY OF THE INVENTION

As shown in FIG. 6, the airflow A primarily flows around the core structure 101 and inside the flow-rectifying member 104 in the direction of the coils 102 and 103. Thus, in terms of the cooling air flowing between the coils 102 & 103 and the core structure 101, the airflow B1 is dominant and the internal airflow B2 is insignificant, and there is also little airflow flowing through the gaps between the coils 102 and 103.

Accordingly, in the conventional technology, it was difficult to uniformly and sufficiently cool the coils 102 & 103 and the core structure 101.

As a countermeasure, a solution of the present invention is to provide a cooling structure for a coil unit that makes the resistances of the flow channels for the cooling air around the coils uniform in order to efficiently and uniformly cool the coils and cooling structure. Accordingly, the present invention is directed to a scheme that substantially obviates one or more of the problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a coil device with a cooling structure, including:

a coil unit that has a core structure having one or more leg parts and one or more coils wound around the one or more leg parts; and a flow-rectifying member having a flat plate portion covering a face of the one or more coils and flow-rectifying ribs inwardly protruding from an inner surface of the flat plate portion, the flow-rectifying ribs extending in a direction parallel to center axes of the one or more coils and being positioned to face side boundaries of the face of the one or more coils, wherein the flat plate portion and the flow-rectifying ribs form a first air cooling channel at a substantially uniform gap on an outside of the one or more coils along the direction parallel to the center axes of the one or more coils, the first air cooling channel passing cooling air therethrough so as to air-cool the one or more coils.

In one aspect, it is preferable that the flow-rectifying ribs each have a substantially triangular shape in a cross section taken along a direction perpendicular to the center axes of the one or more coils.

Furthermore, in one aspect, a second air cooling channel may be formed between an inner surface of each of the one or more coils and a surface of each of the one or more leg parts around which the one or more coils is wound, the second air cooling channel having a substantially uniform gap.

In one aspect, the present invention is applicable to a reactor or transformer having the one or more coils respectively wound around a plurality of leg parts of the core structure, for example.

The present invention makes it possible to efficiently and uniformly cool an entire coiled component by attaching a flow-rectifying member having flow-rectifying ribs to the coiled component in order to form a first cooling air channel around the coils, the cooling air then being passed through this channel.

This allows the capacity of a cooling device, such as a cooling fan, to be small, which makes it possible to reduce the total size and cost of a device having coil units embedded therein.

It is to be understood that both the foregoing general description and the following detailed description are exemplary and explanatory, and are intended to provide further explanation of the invention as claimed.

BRIEF DESCRIPTION OF THE DRAWINGS

FIG. 4A is a partial cutout front view; FIG. 4B is a cross-sectional view along line A-A in FIG. 4A; and FIG. 4C is a cross-sectional view along line B-B in FIG. 4A.

FIG. 5A is a plan view; FIG. 5B is a front view; and FIG. 5C is right side view.

DETAILED DESCRIPTION OF EMBODIMENTS

Figure 1:
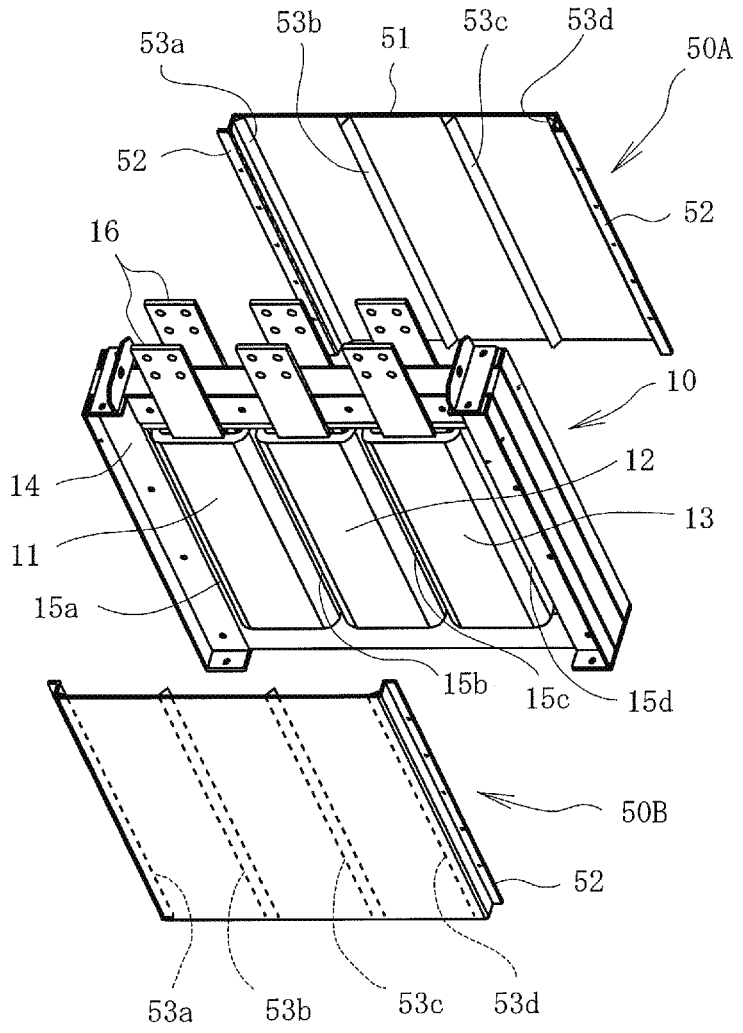
FIG. 1 is an exploded perspective view of a reactor according to an embodiment of the present invention.

An embodiment of the present invention will be explained below with reference to the drawings. This embodiment is the present invention as applied to a shell-type reactor, which is a coil unit; FIG. 1 is an exploded perspective view of the reactor, and FIG. 2 is a plan view of the assembly state.

Figure 2:
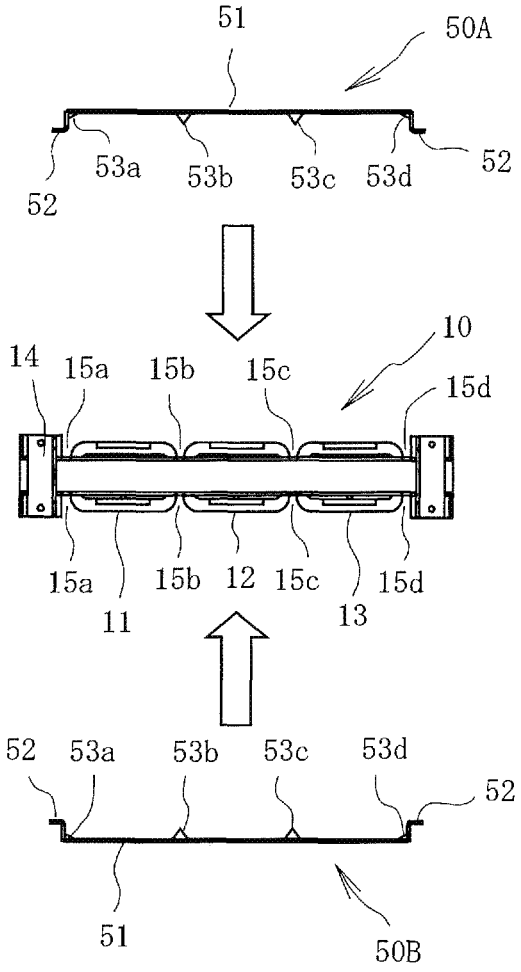
FIG. 2 is a plan view showing an assembly state of FIG. 1.

In FIGS. 1 and 2, reference number 10 is the shell-type reactor, which is the coil unit of a coil device, and this shell-type reactor has three phase coils 11, 12, and 13 and a core structure 14 in which these coils 11, 12, and 13 are wound. The core structure 14 of the coil device has three leg parts respectively disposed in the centers of the coils 11, 12, and 13, and two leg parts disposed outside the coils 11 and 13.

Reference number 16 is an output conductor for connecting the coils 11, 12, and 13 to an external conductor (not shown).

Furthermore, reference numbers 50A and 50B are flow-rectifying members attached from both sides of the coils 11, 12, and 13 so as to sandwich the coils 11, 12, and 13. These flow-rectifying members 50A and 50B include a rectangular flat plate portion 51 covering the side faces of the coils 11, 12, and 13, fixing ends 52 formed on both ends of the flat plate portion, and flow-rectifying ribs 53*a*, 53*b*, 53*c*, and 53*d* formed on the inner surface of the flat plate portion 51 (i.e., on the surface of the flat plate portion facing the coils 11, 12, and 13).

As shown in FIG. 2, the flow-rectifying ribs 53*a*, 53*b*, 53*c*, and 53*d* are formed to have an approximately triangular cross section so as to face the corner portions 15*a*, 15*b*, 15*c*, and 15*d* of the outer peripheral surfaces of the coils 11, 12, and 13 while maintaining a uniform gap therebetween. These flow-rectifying ribs 53*a*, 53*b*, 53*c*, and 53*d* are protrusion-shaped members that are parallel to the center axes of the coils 11, 12, and 13 and longer than the axial direction length of the coils 11, 12, and 13.

The flow-rectifying members 50A and 50B containing the flow-rectifying ribs 53*a*, 53*b*, 53*c*, and 53*d* are each entirely and integrally fabricated of a resin or metal material.

Figure 3:
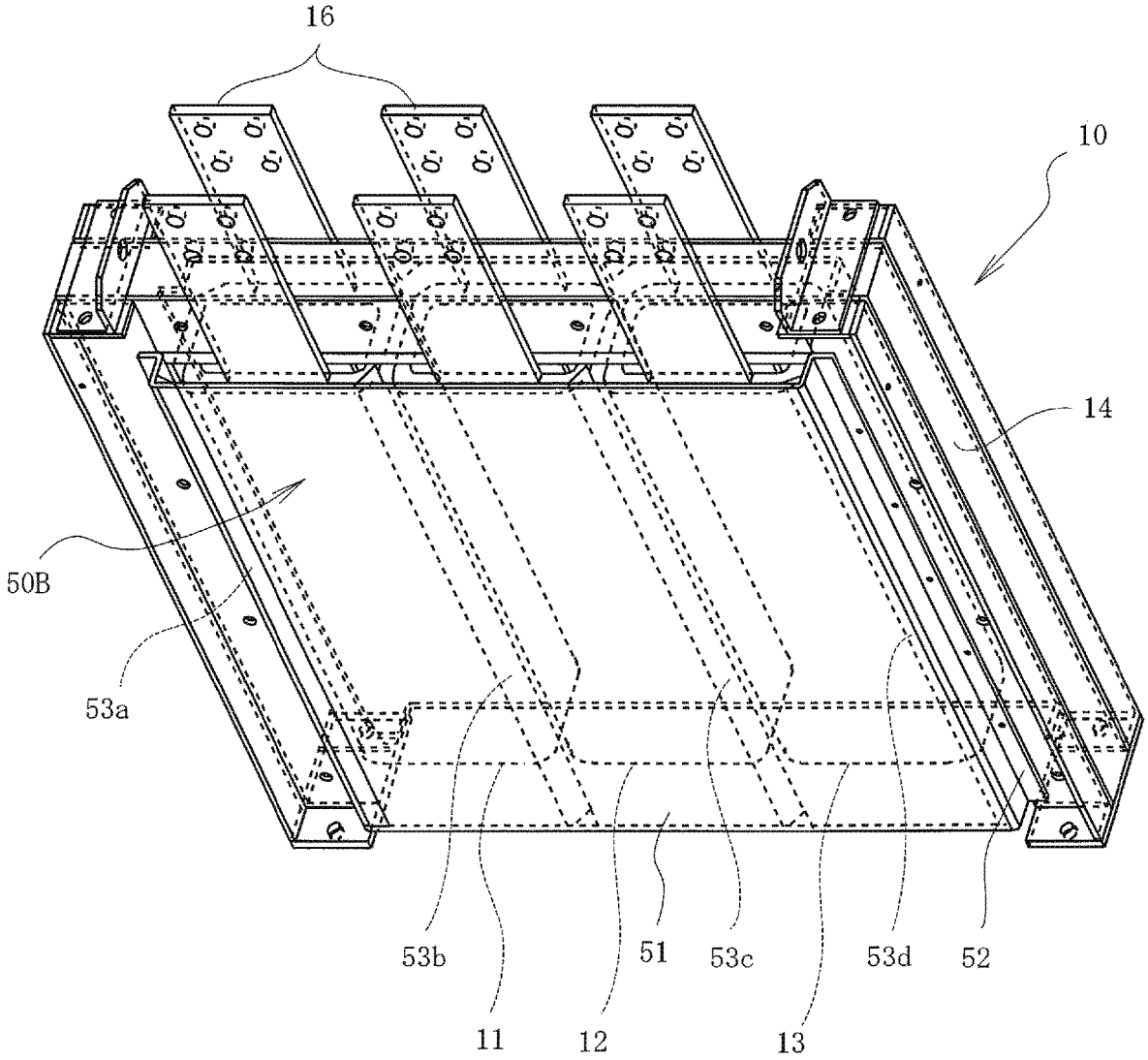
FIG. 3 is a perspective view of an embodiment of the present invention.

FIG. 3 is a perspective view of a reactor formed by combining the reactor 10 and the flow-rectifying members 50A and 50B. The flow-rectifying members 50A and 50B are attached to the outer leg parts 14*a* and 14*e* of the core structure 14 on both sides of the reactor 10 by an adhesive, spot welding, or the like.

Figure 4A:
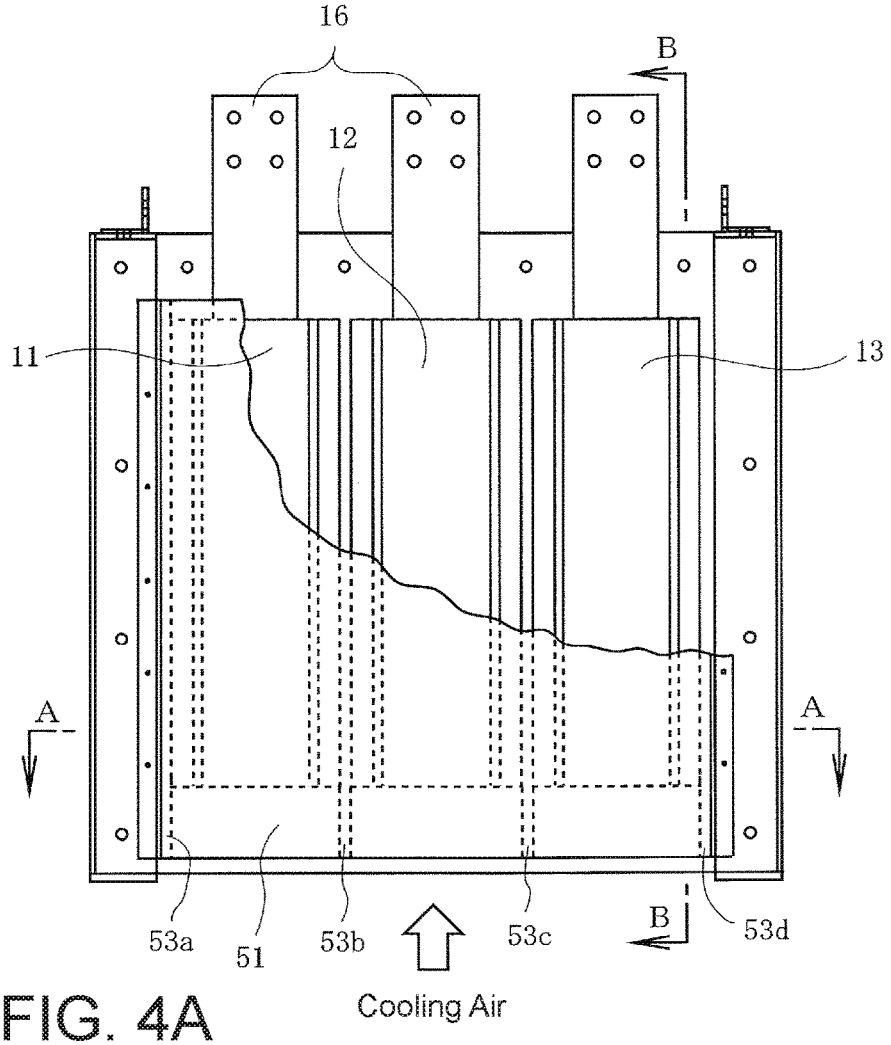
FIGS. 4A to 4C are views of an embodiment of the present invention.
Figure 4B:
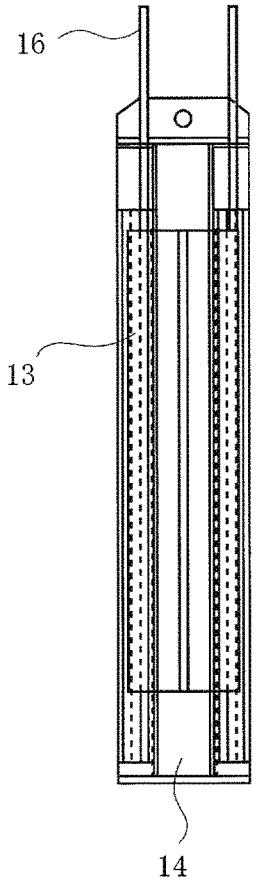
Figure 4C:
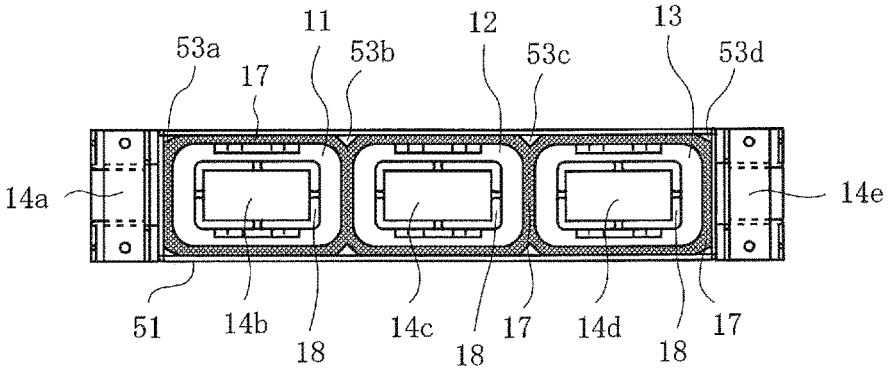
Figure 5A:
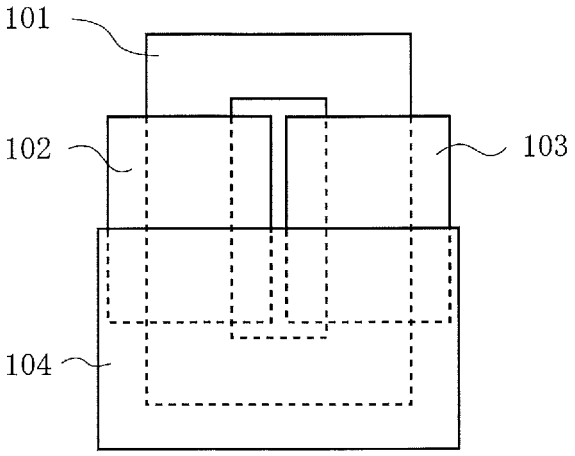
FIG. 5A Prior Art
FIGS. 5A to 5C are views of a core-type reactor described in Patent Document 1.
Figure 5B:
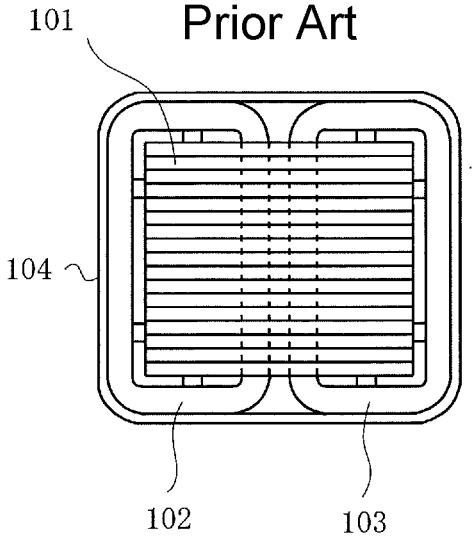
FIG. 5B Prior Art
Figure 5C:
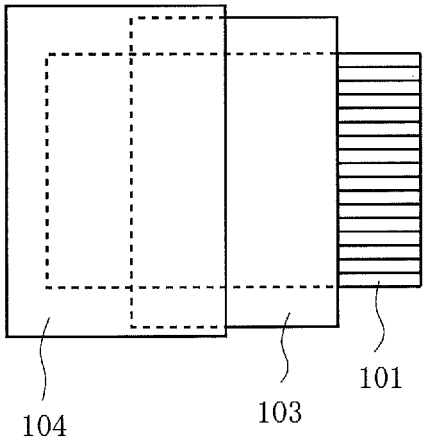
FIG. 5C Prior Art
Figure 6:
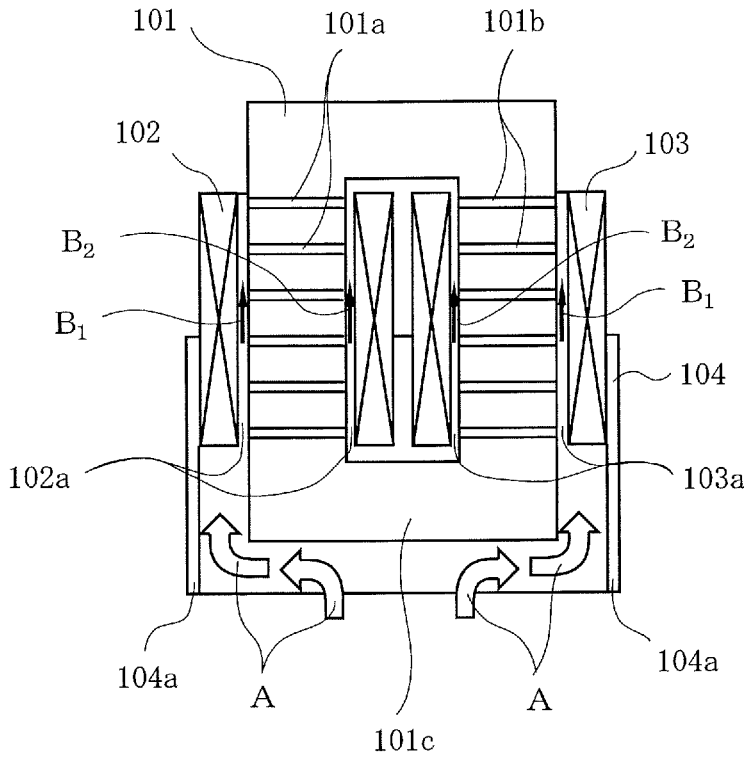
FIG. 6 Prior Art
FIG. 6 is a plan view for describing the cooling effect of the reactor in FIGS. 5A to 5C.

FIG. 4A is front view in which a portion of the flat plate portion 51 of the flow-rectifying member 50B has been cut out, FIG. 4B is a cross-sectional view along line A-A of FIG. 4A, and FIG. 4C is a cross-sectional view along line B-B. Hatching to indicate a cross section has been omitted for convenience.

As shown in FIG. 4B, gaps that will serve as first cooling air channels 17 (or tunnels; the shaded portions) are maintained between the coils 11, 12, and 13, between the outer leg part 14*a* and the outer peripheral surface of the coil 11, and between the outer leg part 14*e* and the outer peripheral surface of the coil 13. In FIG. 4B, the reference numbers 14*b*, 14*c*, and 14*d* are each leg parts around which the coils 11, 12, and 13 are wound.

In this embodiment, as shown in FIG. 4A, when cooling air generated by a cooling fan etc. (not shown) is supplied from below the reactor, the resulting airflow passes through the cooling air channels 17 formed on the outer peripheral surfaces of the coils 11, 12, & 13 and flows towards the output conductors 16.

In the present embodiment, the flow-rectifying members 50A and 50B, which include the flat plate portions 51 and flow-rectifying ribs 53*a*, 53*b*, 53*c*, and 53*d*, are attached between the leg parts 14*a* and 14*e* and sandwich the coils 11, 12, and 13 from both sides. As shown in FIG. 4B, this forms the first cooling air channels 17 on the outer peripheral surfaces of the coils 11, 12, and 13 at generally uniform widths along the direction perpendicular to the center axes of the coils. As a result, the resistances of the flow channels around the coils 11, 12, and 13 become generally uniform, and the cooling air passes evenly across the outer peripheral surfaces of the coils 11, 12, and 13; thus, the coils 11, 12, and 13 can each be uniformly cooled from outside.

Furthermore, by forming second cooling air channels 18 (or tunnels) between the inner peripheral surfaces of the coils 11, 12, & 13 and the outer peripheral surfaces of the leg parts 14*b*, 14*c*, and 14*d* at generally uniform widths along the direction perpendicular to the center axes of the coils 11, 12, and 13, it is possible to cool the inner peripheral surfaces of the coils 11, 12, & 13 and the outer peripheral surfaces of the leg parts 14*b*, 14*c*, and 14*d*.

In other words, the first cooling air channels 17 and the second cooling air channels 18 cool the coils 11, 12, & 13 from inside and outside and can uniformly cool the leg parts 14*a*, 14*b*, 14*c*, 14*d*, and 14*e*.

INDUSTRIAL APPLICABILITY

The present invention is applicable as a cooling structure for various types of single-phase, multi-phase, core-type, or shell-type coil units having coils and a core structure, such as a transformer, reactor, or the like.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A coil device with a cooling structure, comprising:

a coil unit that has a core structure having one or more leg parts and one or more coils wound around said one or more leg parts; and a flow-rectifying member having a flat plate portion covering a face of said one or more coils and flow-rectifying ribs inwardly protruding from an inner surface of the flat plate portion, the flow-rectifying ribs extending in a direction parallel to center axes of said one or more coils along at least an entire length of said one or more coils in said direction, and being positioned to face side boundaries of said face of said one or more coils, wherein the flat plate portion and the flow-rectifying ribs are not in contact with said one or more coils and form a first air cooling channel at a substantially uniform gap on an outside of said one or more coils along said direction parallel to the center axes of said one or more coils, said first air cooling channel passing cooling air therethrough so as to air-cool said one or more coils.

2. The coil device with the cooling structure according to claim 1, wherein the flow-rectifying ribs each have a substantially triangular shape in a cross section taken along a direction perpendicular to the center axes of the one or more coils.

3. The coil device with the cooling structure according to claim 1, wherein a second air cooling channel is formed between an inner surface of each of said one or more coils and a surface of each of the one or more leg parts around which said one or more coils is wound, said second air cooling channel having a substantially uniform gap.

4. The coil device with the cooling structure according to claim 1, wherein the coil unit is a reactor or transformer having said one or more coils respectively wound around a plurality of leg parts of the core structure.

5. The coil device with the cooling structure according to claim 1, wherein the core structure further includes a pair of outermost leg parts around which no coil is wound, and wherein inner side faces of the respective outermost leg parts, the flat plate portion and the flow-rectifying ribs of the flow-rectifying member form an air cooling tunnel surrounding said one or more coils at said substantially uniform gap along at least the entire length of said one or more coils in said direction.

* * * * *